US007057569B2

(12) United States Patent
Isoifovich et al.

(10) Patent No.: US 7,057,569 B2
(45) Date of Patent: Jun. 6, 2006

(54) BROADBAND SLOT ARRAY ANTENNA

(75) Inventors: Sukhovetski Boris Isoifovich, Seoul (KR); Jung Hur, Gyeonggi-do (KR)

(73) Assignees: Astone Technology Co., Ltd., Anyang-Si (KR); Kunsoo Industrial Co., Ltd., Ulsan (KR)

( * ) Notice: Subject to any disclaimer, the term of this patent is extended or adjusted under 35 U.S.C. 154(b) by 0 days.

(21) Appl. No.: 10/509,163

(22) PCT Filed: Sep. 23, 2004

(86) PCT No.: PCT/KR2004/002441

§ 371 (c)(1),
(2), (4) Date: Mar. 30, 2005

(87) PCT Pub. No.: WO2005/031919

PCT Pub. Date: Apr. 7, 2005

(65) Prior Publication Data

US 2006/0066495 A1 Mar. 30, 2006

(30) Foreign Application Priority Data

Sep. 30, 2003 (KR) ..... P2003-0067832

(51) Int. Cl.
*H01Q 13/10* (2006.01)

(52) U.S. Cl. ..... 343/770; 343/767

(58) Field of Classification Search ..... 343/767, 343/770

See application file for complete search history.

(56) References Cited

U.S. PATENT DOCUMENTS

| | | | | |
|---|---|---|---|---|
| 6,538,614 | B1 * | 3/2003 | Fleming et al. | 343/767 |
| 2004/0066345 | A1 * | 4/2004 | Schadler | 343/767 |
| 2005/0088354 | A1 * | 4/2005 | Chang | 343/767 |

* cited by examiner

*Primary Examiner*—Tan Ho
(74) *Attorney, Agent, or Firm*—Workman Nydegger

(57) ABSTRACT

A broadband slot array antenna employs a closely arranged array of slot antennas to minimize antenna size. The antenna array includes a common input terminal; a conductor plate having a common slot formed in a predetermined area and a plurality of slot halves being formed separately and respectively communicating with the common slot via a plurality of slot necks spaced by a predetermined distance; a plurality of feed lines, each having one terminus connected to the common input terminal, for applying power to the conductor plate at a cross coupling point; and a dielectric layer disposed between the conductor plate and the plurality of feed lines.

13 Claims, 10 Drawing Sheets

BROADBAND SLOT ARRAY ANTENNA

This application is a 371 of PCT/KR04/02441 file Sep. 24, 2004.

TECHNICAL FIELD

The present invention relates to a broadband slot array antenna, in which a common slot communicates with a plurality of half slots to minimize a distance between array elements of the antenna while increasing its gain and realizing a specific radiation pattern.

BACKGROUND ART

A typical radio wave antenna essentially performs two functions simultaneously or alternately, and in a transceiver system, the two functions may be achieved by the same antenna or by separate antennas. That is, as a transmitting antenna, an antenna generates a radio wave by radiating into the atmosphere an electrical signal produced by an electronic circuit, and as a receiving antenna, an antenna receives from the atmosphere such a radio wave for conversion into an electrical signal by a receiver circuit. For example, an antenna for receiving a television broadcast converts a broadcast radio wave into a current signal, which is then input to a television receiver.

Assuming that antenna characteristics, such as directional properties and operating frequency, are appropriate for a transmission (radiation) of radio waves, the reception of such radio waves by the same antenna follow the same characteristics. Hence, for the sake of convenience in explaining antenna operational principles and overall antenna theory, a transmitter antenna is frequently presumed to be a receiver antenna as well, such that antenna components such as radiating elements and feed lines are generally termed based on a transmitting operation. That is, an electrical signal output from a transmitter circuit is supplied to a feed line, which in turn supplies the signal to a radiating element, so that the radiating element can radiate a radio wave signal. A reception of radio waves by the same antenna follows a reverse sequence of the above steps, whereby the radiating element receives a radio wave from the atmosphere to produce an electrical signal, which is fed out through the feed line for input to a receiver circuit.

A good antenna has efficient transfer of energy properties and is tuned such that a large current signal is produced (peaked) for a given radio wave. While such criteria are applicable to both analog and digital broadcasts, their reception characteristics of a radio wave signal differ. Namely, reception quality continues to be degraded as received signal strength weakens in an analog television receiver, whereby ghosting occurs and the video display becomes increasingly snowy, while a similar reception by a digital television receiver maintains a high quality output until the received signal strength drops to a predetermined level, whereupon the reception quality is greatly degraded to include audio dropout and video blocking. Normal broadcast reception is enabled, in either system, by securing a proper level of received signal strength and signal-to-noise ratio and by overcoming multi-path problems.

A broadband slot antenna is applicable to the transmission and reception of television and AM/FM radio broadcasts, which use relatively low frequencies, i.e., long wavelengths, and therefore require relatively large antennas. Meanwhile, characteristics of an antenna for use by a broadcast station can be freely determined with little regard to cost or size, but in designing an antenna for receiving a broadcast signal, costs must be kept low and size should be minimized while maintaining required performance levels.

A slot antenna has long been in practical use due to its planar structure and its facilitation of broadband communications. A slot array antenna, made up of an array of hundreds or thousands of slots, has shortwave radar and satellite broadcast applications. The array of such an antenna enhances gain but increases overall antenna size, which inhibits application in VHF to low UHF broadcasting.

The slot antenna basically consists of one or more slots having a length of one half wavelength ($\lambda/2$). Power is fed to a slot using a microstrip (power feed line) intersecting the slot perpendicularly, the intersection usually occurring at the slot's center, for an efficient transfer of current (cross coupling) via a conductive connection, i.e., a short, or a capacitive coupling, i.e., an open, at a cross coupling point of the power feed line. To increase bandwidth in a slot antenna, the slot width is increased symmetrically from the slot's center to either end, to provide a variety of slot configurations, including bowtie, dog-bone, and paddle-bowtie configurations. Since the end width of any of these slots is considerably greater than that of a general slot, the resulting antenna size is increased accordingly. That is, when two such antennas are arranged in parallel, i.e., side by side, the space between the antennas (spatial margin) is increased over that of a normal slot antenna array, particularly in terms of width. Therefore, in arraying a plurality of such antennas, the accumulative space greatly increases antenna size. Moreover, if the spatial margin is too narrow, the antenna's electrical characteristics suffer.

General terminology for slot antenna technology, including "radiation," "conductor," "dielectric," "radiating element," "conductor plate," "bowtie/dog-bone slot," "dielectric substrate," "microstrip antenna," "array antenna," "feed line," and "coplanar waveguide," is herein preferentially defined as follows.

Radiation is a phenomenon whereby radio waves are propagated from an antenna element into an empty space, i.e., the atmosphere.

A conductor is a material capable of carrying an electric current, and current tends to flow well in conductors made of molecularly dense materials, specifically metals such as silver, copper, gold, and aluminum. The radiating element of an antenna is essentially a conductor and, considering antenna cost and other factors, is primarily made of copper and/or aluminum. Silver and gold, in limited quantities, may also be used as the material for the radiating element.

A dielectric is a material which promotes electromagnetism but which inhibits a direct flow of an electric current and is therefore also termed an insulator. Due to these properties, a dielectric is generally used for creating a spatial separation between conductors of the radiating element of an antenna, while providing mechanical support for the conductors. Air can be considered a dielectric.

A radiating element is a structural component of an antenna and consists mainly of a conductor formed to radiate radio waves into the atmosphere. The radiating elements of a microstrip antenna may be a radiating patch or a radiating aperture. The radiating patch forms a radiating element using a conductor plate of a regular shape such as a circle, oval, triangle, quadrangle, or pentagon, while the radiating aperture forms a radiating element using a conductor plate perforated with an aperture of such a shape. When the aperture shape is a slot, the radiating aperture may be termed a radiating slot.

A conductor plate is a thin, flat plate made of a conductor and can be variously shaped to construct an antenna. One portion of a conductor plate (i.e., a radiating patch) may be used as a radiating element, while another portion of a conductor plate (i.e., a power feeding patch) may be used as a power feeding element. The radiating element may be a radiating slot, for example, a bowtie slot or dog-bone slot, which is formed by removing a portion of a conductor plate. A feed line may be formed by removing most of a conductor plate, leaving only a strip of the conductor material. A radiating patch and a feed line may be simultaneously formed by removing predetermined portions of a conductor plate. A conductor plate can also be used as a grounded conductor plane and/or a reflective plate.

A bowtie or dog-bone slot extends the operational bandwidth of a slot antenna. That is, while a slot antenna's operational bandwidth is relatively narrow when a conductor plate has a plurality of uniform slots, the formation of a bowtie slot or dog-bone slot will extend its operational bandwidth. A bowtie slot configuration is achieved by a radiating slot having a symmetrically increasing slot width toward the slot ends, and a dog-bone slot configuration is achieved by circular radiating apertures communicating with the slot ends. A slot antenna may have features of both types, i.e., a bowtie slot and a dog-bone slot.

A dielectric substrate is a thin, flat plate made of a dielectric (insulator). In configuring an antenna, the dielectric substrate is used for isolating a pair of conductor plates, to thereby be separated by a uniform distance. A conductor plate, having a surface area corresponding to the area of the dielectric substrate, can be abutted against one or both faces of a dielectric substrate, as in printed circuit board (PCB) technology, and similar to PCB technology, a dielectric substrate is called a single-face dielectric substrate when the conductor plate is abutted against one face and is called a double-face dielectric substrate when the conductor plate abuts both faces. Accordingly, a broadband slot array antenna may use a single-face dielectric substrate, a double-face dielectric substrate, and/or a simple dielectric substrate (i.e., without any conductor plate), to produce a stacked structure (i.e., without adhesion) where a dielectric substrate is alternately stacked on a conductor plate or a conductor plate is alternately stacked on a conductor plate. Thus, in addition to a single-face dielectric substrate, a triple-decked (sandwiched) structure may be provided, whereby one dielectric substrate is disposed between a pair of conductor plates.

A microstrip antenna is essentially a panel-type (flat) antenna fabricated by forming radiating elements or feed lines on a conductor plate used with one or more of the various dielectric substrates. Hence, the microstrip antenna has a structure in which conductor plates and dielectric substrates are alternately stacked. For instance, a general microstrip antenna has a five-layer structure, stacking a grounded conductor layer (a first layer), a dielectric layer (a second layer), a feed line conductor layer (a third layer), a dielectric layer (a fourth layer), and a radiating element conductor layer (a fifth layer). The fabrication of such a structure can be provided by interposing dielectric layers between the first, third, and fifth layers each having a predetermined shape or by simultaneously processing (shaping) the first, second, and third layers on one double-face dielectric substrate, simultaneously processing the fourth and fifth layers on one single-face dielectric substrate, and then stacking the two dielectric substrates. The feed lines or radiating elements can be fabricated from conductor plate material attached to a single-face or double-face dielectric substrate in a manner very similar to that of fabricating a printed circuit board, resulting in an antenna called a PCB antenna, whereby a desired portion of the conductor plate material is defined using photolithography and the remainder is chemically removed by etching. Regardless of the method of fabrication, however, a microstrip antenna is generally called a PCB antenna.

An array antenna consists of at least two radiating elements arranged into a parallel array. Typically, however, the radiating elements number in the tens to hundreds and may even number in the tens of thousands. The radiating elements may be radiating patches or radiating slots.

A feed line is a line (conductor) for supplying an electrical signal to a radiating element, which may be achieved by a conductive connection or a capacitive coupling. The feed line mainly uses a microstrip but may use a coaxial line, a coplanar waveguide, a slot line, or the like. A power feed line uses a power-feeding element.

A coplanar waveguide is a planar transmission line created by forming (e.g., etching) in a conductor plate a corresponding pair of parallel slots, to leave a strip of conductor plate material between the slots. Preferably, the slots have the same width.

FIGS. 1A–1K show general slot antenna configurations, in which a slot is formed in one of several conductor plates 100*a*–100*k* and a pair of feed lines 112 are respectively connected across the center of the slot.

In FIG. 1A, a basic slot 101 has a simple narrow slot formed in the conductor plate 100*a* and exhibits a narrow operational bandwidth, which can be increased by modifying this basic configuration. For instance, a bowtie slot 102 or 103 is a modification of the basic slot antenna, in which broadband characteristics are achieved by increasing the slot width symmetrically toward the slot ends, whereby the slot is formed by straight slot sides as in FIG. 1B or by curved slot sides following the locus of an exponential function as in FIG. 1C. A wide slot width may be kept constant over the length of each symmetrical half of a bowtie slot, forming the paddle shape of a paddle-bowtie slot 104, as shown in FIG. 1D.

Broadband characteristics may also be achieved by forming an aperture communicating with each end of the basic slot 101 to provide a dog-bone slot 105 (FIG. 1E), a T-type slot 106 (FIG. 1F), or a Y-type slot 107 (FIG. 1G). Further antenna configurations include antenna slots 108 (FIG. 1H), 109 (FIG. 1I), 110 (FIG. 1J), and 111 (FIG. 1K) by forming rectangular, triangular, fan-shaped, or semicircular apertures communicating with the basic slot 101.

Referring to FIG. 2, illustrating the configuration of a broadband paddle-bowtie slot antenna according to a related art, a pair of wide slots 206 respectively communicate with each side of a bowtie slot 205, thereby forming a paddle-bowtie slot 231 having a paddle shape. The antenna is driven by feeding power to the slot via a microstrip 218 opposing a conductor plate 200, which is essentially a grounded surface. Thus, the microstrip 218 is a feed line extending from an input terminal 216 to a contact terminal 210, which traverses a slot neck 201 to be connected (grounded) to the conductor plate 200. The feed line may be constituted by a modified microstrip, a coaxial line, coplanar waveguide, or slot line.

To increase operational bandwidth, a plurality of slots are arrayed to form a broadband slot array antenna. Representative of such an array, FIG. 3 shows a paddle-bowtie slot array antenna according to a related art, in which broadband paddle-bowtie antennas 306 and 307 are arranged in parallel together on a conductor plate 300. To reduce a mutual interference occurring between the two antennas, a minimum inter-antenna element distance d should be maintained, where d is equal to at least λ/2. This minimum distance proscribes further miniaturization of a broadband paddle-bowtie slot array antenna, which limits its application.

DISCLOSURE OF INVENTION

Accordingly, the present invention is directed to a broadband slot array antenna that substantially obviates one or more problems due to limitations and disadvantages of the related art.

An object of the present invention is to provide a broadband slot array antenna, which arrays a plurality of slots close together, by modifying the structure of each slot to provide a closely arranged array of parallel slot antennas.

Another object of the present invention is to provide a broadband slot array antenna, which minimizes overall antenna size.

Another object of the present invention is to provide a broadband slot array antenna, which facilitates application in VHF to low UHF broadcasting.

Another object of the present invention is to provide a broadband slot array antenna, which maintains the characteristics of a slot array antenna while reducing an inter-antenna element distance.

Another object of the present invention is to provide a broadband slot array antenna, which reduce an inter-antenna element distance to less than λ/2.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages in accordance with the purpose of the invention, as embodied and broadly described herein, there is provided a broadband slot array antenna comprising a common input terminal; a conductor plate having a common slot formed in a predetermined area and a plurality of slot halves being formed separately and respectively communicating with the common slot via a plurality of slot necks spaced by a predetermined distance; a plurality of feed lines, each having one terminus connected to the common input terminal, for applying power to the conductor plate at a cross coupling point; and a dielectric layer disposed between the conductor plate and the plurality of feed lines.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

The basic concept of the present invention lies in that, when two or more slot antennas are arrayed in parallel, antenna characteristics can be maintained without mutual interference, by arranging the slot antennas proximate each other such that the inter-antenna element distance is less than λ/2, whereby adjacent slots are of a plurality of bowtie, dog-bone, or paddle-bowtie slot antennas communicate with each other. By this arrangement of the present invention, a new paddle-bowtie slot antenna is realized.

Figure 4A:
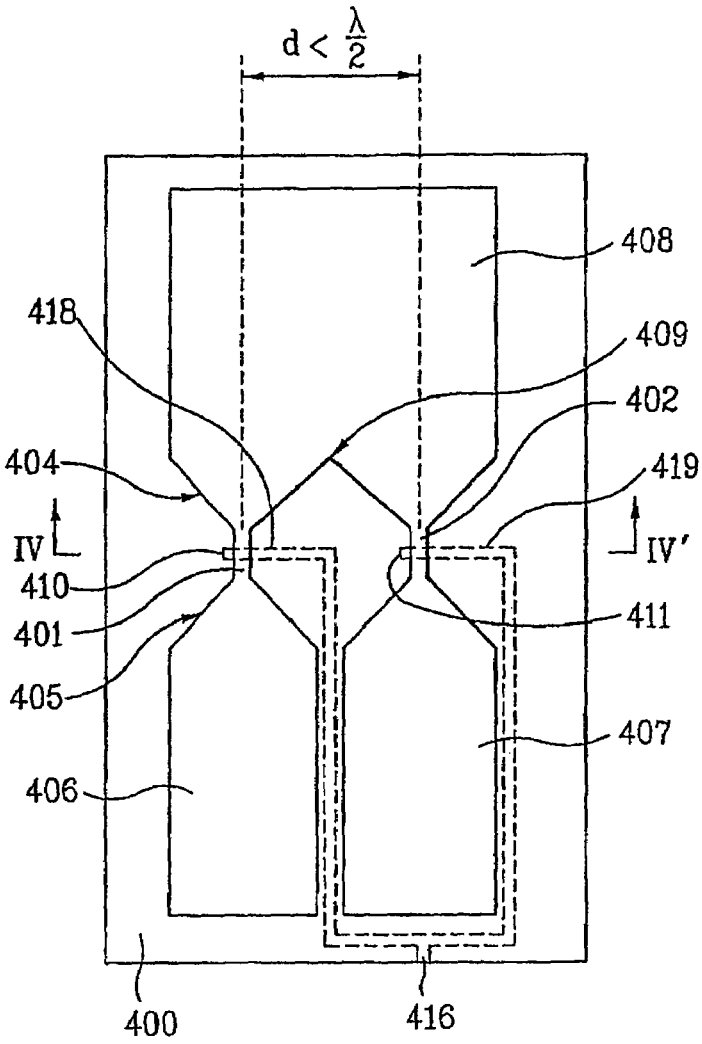
FIG. 4A is a plan view of a broadband slot array antenna according to one embodiment of the present invention.

FIG. 4A illustrates a broadband slot array antenna according to one embodiment of the present invention, in which an exemplary pair of slot antennas is representative of an array. Here, adjacent antennas are arranged by reducing the spatial margin beyond its presupposed minimum distance, rather than maintaining an inter-antenna element distance greater than λ/2 as in the related art. That is, the slot antennas of the new paddle-bowtie slot antenna of the present invention are positioned in very close proximity, such that adjacent slots are merged along the opposing sides of a corresponding plurality of slot halves. In doing so, the respective phases of the electromagnetic field generated by two adjacent slots coincide with each other.

The present invention is a new slot array antenna configuration, essentially merging the slots of a known configuration to form a new type of antenna having a plurality of slots—preferably, paddle-bowtie slots—positioned in very close proximity. The apparent result of such proximate positioning is that a pair of paddle-bowtie slots are simply set close to each other. In other words, a known configuration of plural antenna slots set close together. The anticipated results for a very close placement of such slots would be a complete failure of antenna operation due to a radical alteration of normal antenna characteristics, including mutual interference problems, even if the original placement of the slots (i.e., a normal slot configuration) exhibited excellent characteristics. According to the slot configuration of the present invention, however, the mutual interference between the two antenna elements brings about wholly new and unexpected characteristics, and desired characteristics can be acquired within a specific frequency range by considering the phases of the electromagnetic field generated by the array structure.

Figure 1A:
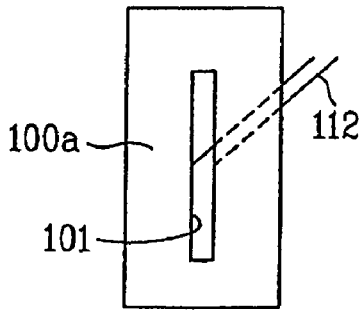
FIG. 1A Related Art
FIGS. 1A–1K are respective diagrams of general slot antenna configurations.
Figure 1B:
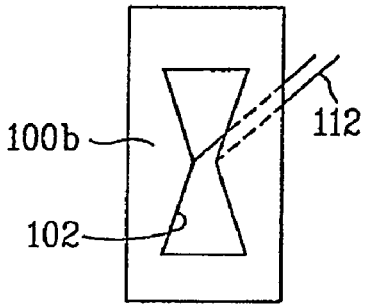
FIG. 1B Related Art
Figure 1C:
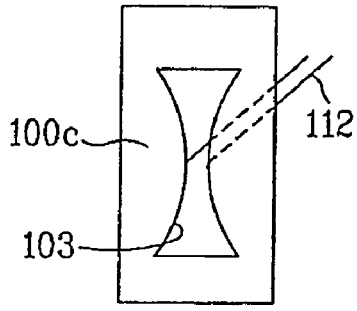
FIG. 1C Related Art
Figure 1D:
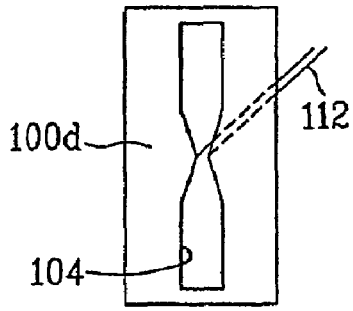
FIG. 1D Related Art
Figure 1E:
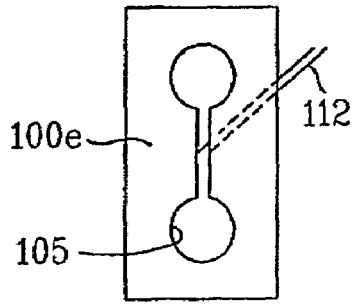
FIG. 1E Related Art
Figure 1F:
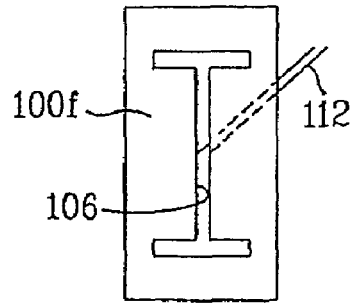
FIG. 1F Related Art
Figure 1G:
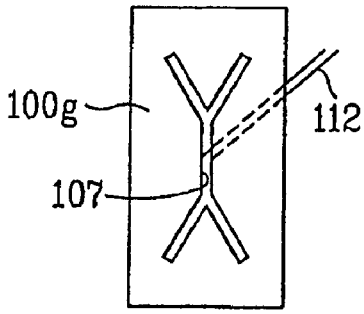
FIG. 1G Related Art
Figure 1H:
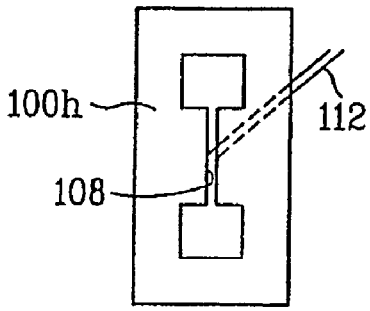
FIG. 1H Related Art
Figure 1I:
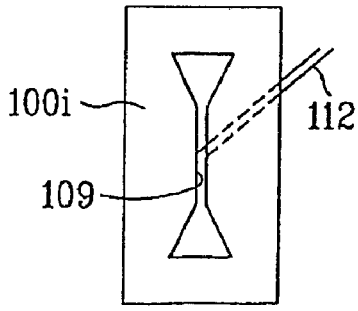
FIG. 1I Related Art
Figure 1J:
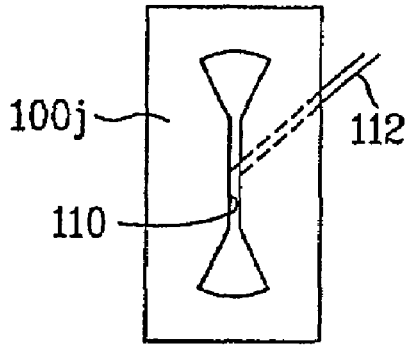
FIG. 1J Related Art
Figure 1K:
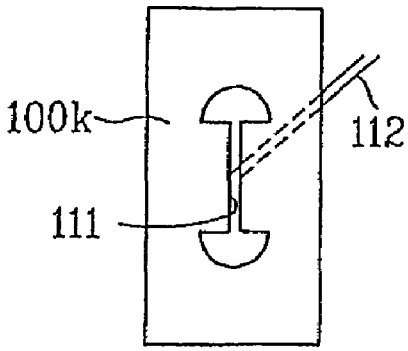
FIG. 1K Related Art
Figure 2:
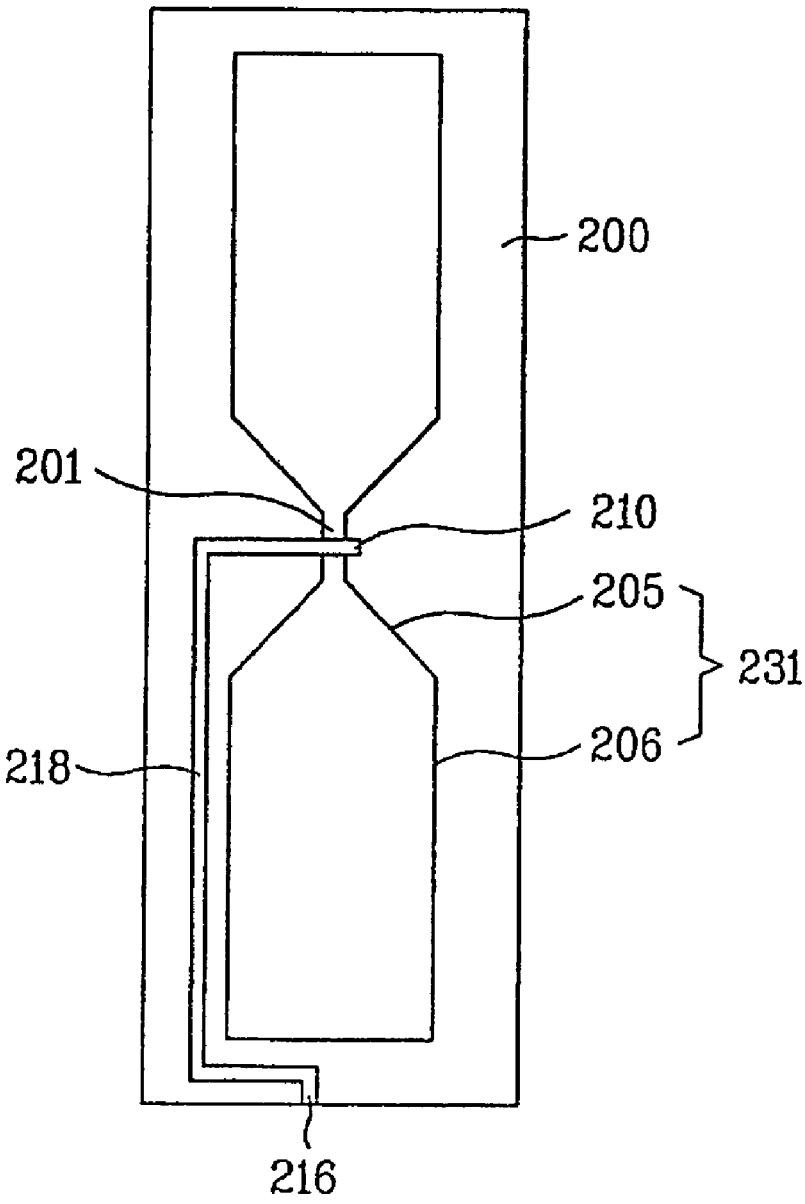
FIG. 2 Related Art
FIG. 2 is a plan view of a broadband paddle-bowtie slot antenna according to a related art.
Figure 3:
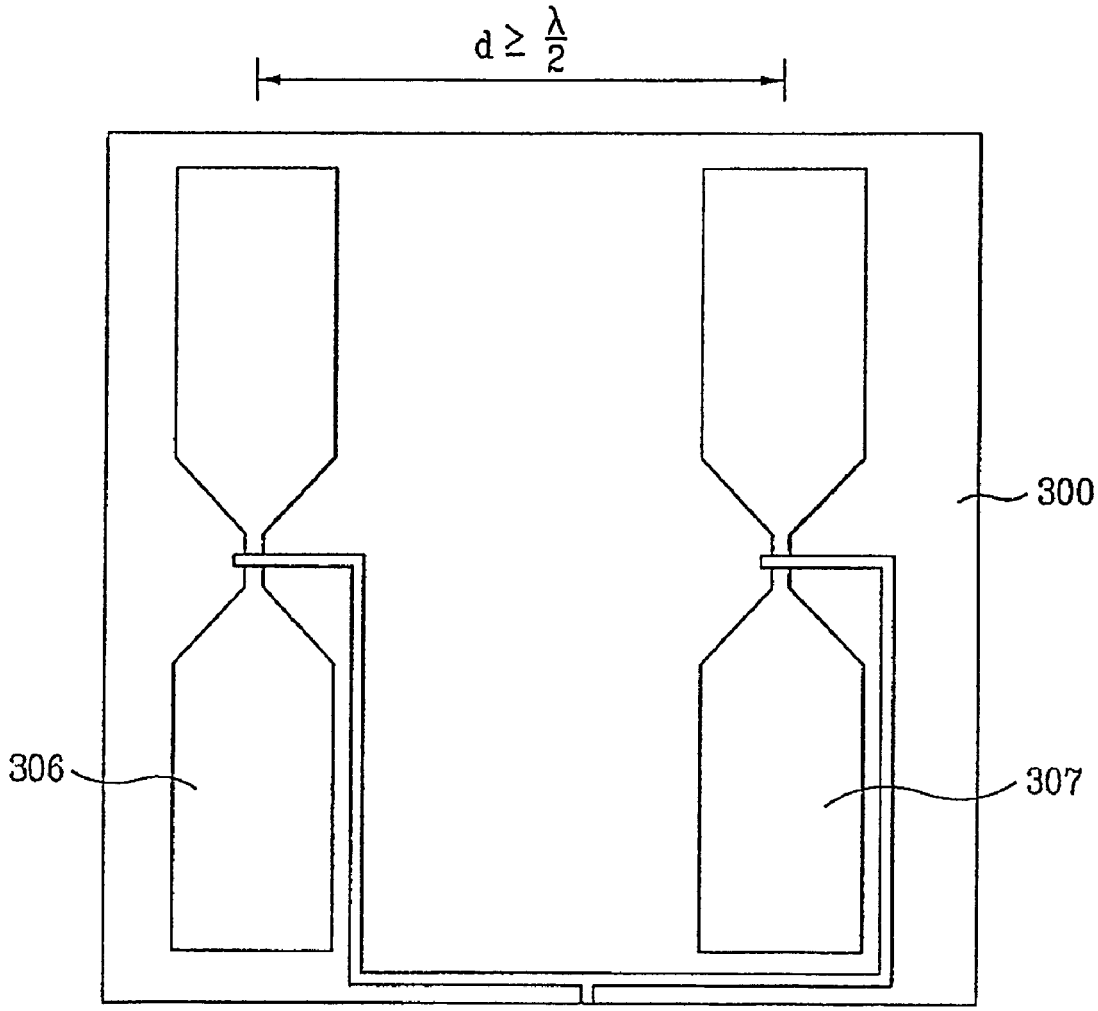
FIG. 3 Related Art
FIG. 3 is a plan view of a broadband paddle-bowtie slot array antenna according to a related art.

Specifically, if the related art paddle-bowtie slots 306 and 306 of FIG. 3 are simply formed close to each other, the mutual interference brings about wholly different antenna characteristics or antenna operation failure. In the present invention, however, the phases of the electromagnetic fields appearing in an adjacent pair of paddle-bowtie slots are made to coincide with each other.

As shown in FIG. 4A, power is fed to the broadband slot array antenna according to the present invention, to be applied to each of a pair of the paddle-bowtie slots formed in a conductor plate established as a ground plane 400 having an indeterminate perimeter. Specifically, the power is fed, using cross coupling, via power feed lines established as a plurality of microstrips 418 and 419 and is applied at slot necks 401 and 402, where slot halves 406 and 407 communicate with a common slot 408 to form the pair of the paddle-bowtie slots. The cross coupling is achieved using the microstrips 418 and 419, which respectively traverse the slot necks 401 and 402 to be electrically coupled with the ground plane 400 at a predetermined cross coupling point corresponding to each slot neck. The cross coupling point is determined so that electromagnetic fields are maximally induced into the slots 406, 407, and 408 and so that the microstrips 418 and 419, each of which extend from a common input terminal 416 to one of a plurality of microstrip termini 410 and 411, are equal in length, namely, $\lambda/4$. Essentially, each of the microstrips 418 and 419 is a waveguide of a length based on the tuned frequency (wavelength=$\lambda$) of the broadband slot array antenna.

The electromagnetic fields are respectively induced (coupled) into the slot halves 406 and 407, and the phase of one field coincides with that of the other. The formation of each antenna element (slot), formed of one slot half (406 or 407) and a corresponding portion of the common slot 408, includes an inter-slot apex 409 and tapered edges 404 and 405, which are configured in consideration of the electromagnetic fields to be generated by the respective elements of the slot array. Each of the slot halves 406 and 407 has a length corresponding to that of the common slot 408 and a width consistent with that of a normal paddle-bowtie slot antenna, while the overall width of the common slot generally corresponds to that of the slot array itself. In the configuration of the present invention, the slot halves 406 and 407 are separately formed and are arrayed in opposition to the common slot 408, which occupies an area equal to the mirror of the area the slot halves plus an area of spatial margin.

Figure 4B:
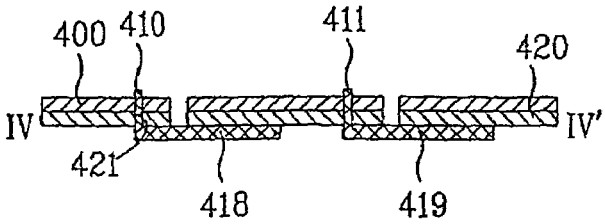
FIG. 4B is a cross-sectional diagram of the broadband slot array antenna cut along a line IV–IV' in FIG. 4A.

In the preferred embodiment of the present invention, when the power is fed via microstrips 418 and 419 to intersect each of the slot necks 401 and 402 perpendicularly, an efficient cross coupling occurs via a conductive connection, i.e., an electrical short to the ground plane 400, at the respective connections of the microstrip termini 410 and 411. The conductive connection can be seen in FIG. 4B.

Figure 5A:
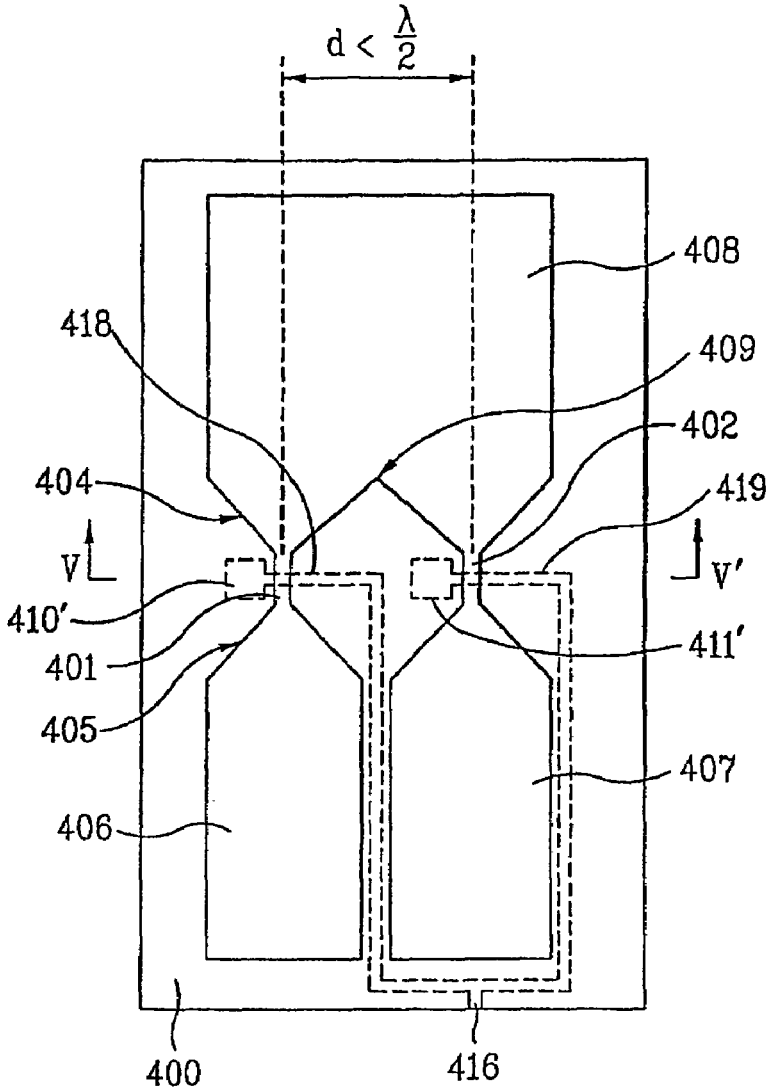
FIG. 5A is a plan view of a broadband slot array antenna according to another embodiment of the present invention.
Figure 5B:
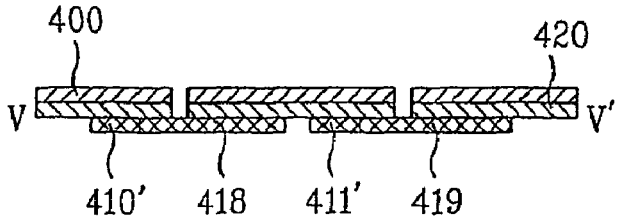
FIG. 5B is a cross-sectional diagram of the broadband slot array antenna cut along a line V–V' in FIG. 5A.

In another embodiment of the present invention, as shown in FIGS. 5A and 5B, when the power is fed via microstrips 418 and 419 to intersect each of the slot necks 401 and 402 perpendicularly. In this embodiment, the cross coupling occurs via a capacitive coupling, i.e., an electrical open across a dielectric layer 420, at each of a plurality of microstrip termini 410' and 411' opposing the ground plane 400 at the predetermined cross coupling point. Accordingly, the microstrips 418 and 419 are effectively extended by one quarter wavelength ($\lambda/4$). In this embodiment, the preferred size and shape of the microstrip termini 410' and 411' are determined to maximize an inducement of electromagnetic fields into the slots 406, 407, and 408, while the lateral dimension of the microstrip termini is kept to a minimum to avoid counteracting the benefit of antenna array miniaturization.

In the broadband slot array antenna according to the present invention, antenna characteristics are optimized, i.e., tuned to a specific frequency range. Tuning can be achieved by various field tests performed after modifying parameters for varying the phases of the electromagnetic fields. These parameters include the length of the microstrips 418 and 419, the orientation of the traversal of the microstrips across the slot necks 401 and 402, the angle and length of tapered edges 404 and 405, the width and length dimensions of the common slot 408 and slot halves slots 406 and 407, and the shape of the inter-slot apex 409. The microstrip dimensions should be determined in consideration of impedance matching with the respective antenna elements, to enable an efficient coupling of their electromagnetic fields. The feed line (microstrip) may also be formed of a modified microstrip having an upper conductor having a circular cross-section or of a coaxial line, coplanar waveguide, or slot line.

The dielectric layer 420 is disposed between the ground plane 400 and the microstrips 418 and 419. The microstrips 418 and 419 (feed lines) traversing the slot necks 403 may be configured such that each is oriented in the same feeding direction, i.e., both leftward or both rightward, or in opposite feeding directions, i.e., leftward and rightward or rightward and leftward, respectively. A reversal of the feeding direction results in a 180° change in the phases of the electric fields induced by the respective slots.

Figure 6:
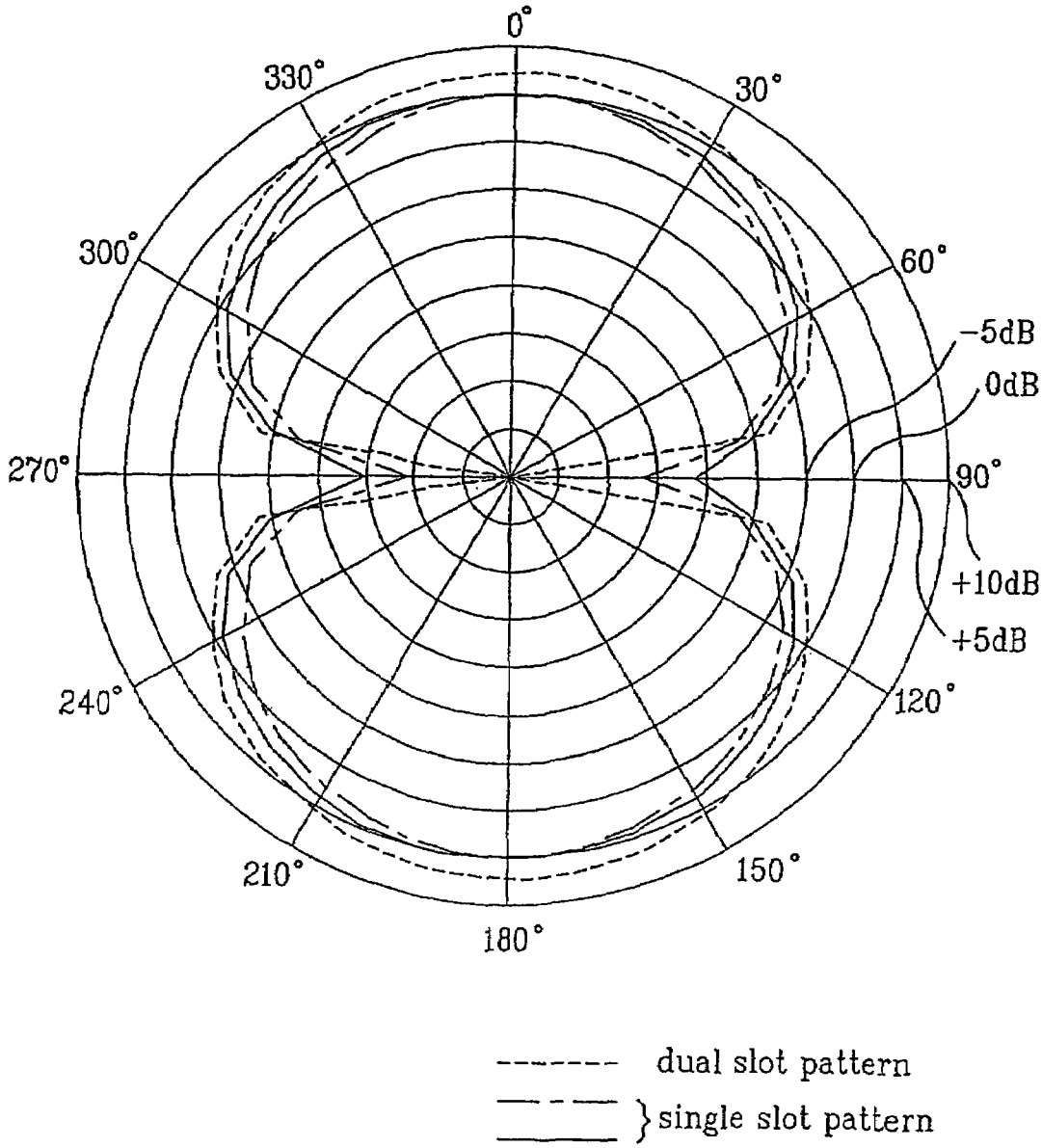
FIG. 6 is a polar graph of a radiation pattern according to the antenna structure exemplified in FIG. 4A.

FIG. 6 shows radiation patterns of paddle-bowtie slot configurations superimposed on one another for comparison. Here, two single-slot plots, one in which only one of the two paddle-bowtie slots (406 or 407) of FIG. 4 is employed and one in which only the other slot is employed, are superimposed on a dual-slot pattern where both the paddle-bowtie slots 406 and 407 are employed, demonstrating a 3 db increase in antenna gain. Meanwhile, it can be seen that when only one—either one—of the paddle-bowtie slots is employed, the resulting antenna gain and radiation pattern are very similar.

Figure 7:
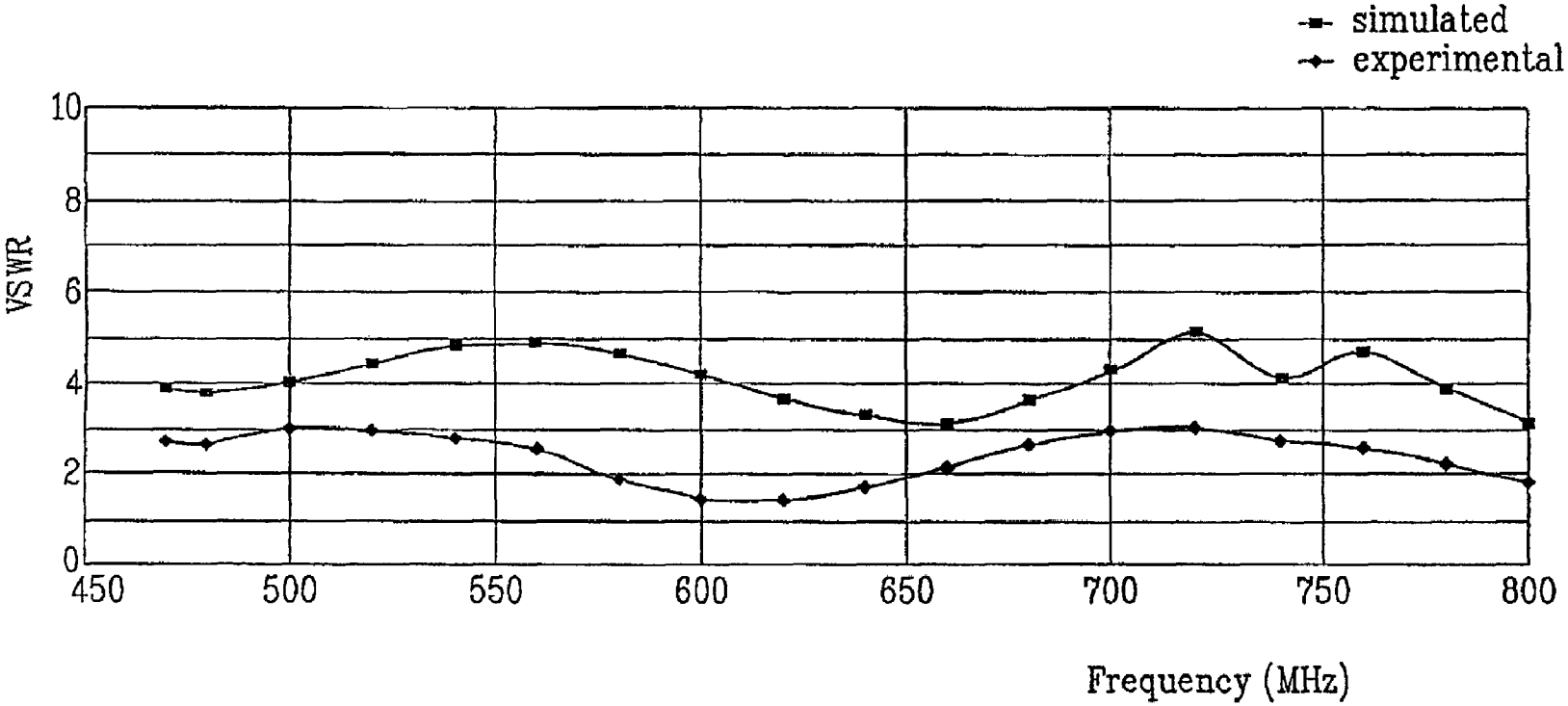
FIG. 7 is a graph of return loss characteristics present at the input of a broadband slot array antenna as shown in FIG. 4A.

FIG. 7 shows that a computer simulated plot of return loss characteristics of the paddle-bowtie slot array antenna according to the present invention correlates with actual (experimental) data. The return loss characteristics are represented as a voltage standing wave ratio (VSWR) measured at the input terminal of the feed line over a frequency range of 450 MHz to 800 Mhz.

Accordingly, in configuring a broadband slot array antenna for increasing an antenna gain or acquiring a specific radiation pattern, the present invention enables a minimization of the distance between the slots without degrading the characteristics of the antenna array elements.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A broadband slot array antenna comprising:

a common input terminal;

a conductor plate having a common slot formed in a predetermined area and a plurality of slot halves being formed separately and respectively communicating with the common slot via a plurality of slot necks spaced by a predetermined distance;

a plurality of feed lines, each having one terminus connected to the common input terminal, for applying power to the conductor plate at a cross coupling point; and a dielectric layer disposed between the conductor plate and the plurality of feed lines.

2. The broadband slot array antenna of claim 1, wherein, when power is applied to the conductor plate, the slot halves respectively produce a plurality of electromagnetic fields having coinciding phases.

3. The broadband slot array antenna of claim 1, wherein the predetermined distance is less than $\lambda/2$.

4. The broadband slot array antenna of claim 1, wherein the plurality of feed lines each have a predetermined length from the common input terminal to the cross coupling point.

5. The broadband slot array antenna of claim 4, wherein the predetermined length is $\lambda/4$.

6. The broadband slot array antenna of claim 5, wherein the cross coupling is achieved by a conductive connection between the feed lines and the conductor plate.

7. The broadband slot array antenna of claim 5 wherein the cross coupling is achieved by a capacitive coupling between the feed lines and the conductor plate.

8. The broadband slot array antenna of claim 1, wherein each feed line traverses one of the plurality of slot halves.

9. The broadband slot array antenna of claim 8, wherein the feed lines traverse the slot necks from one direction.

10. The broadband slot array antenna of claim 8, wherein the feed lines traverse the slot necks from opposing directions.

11. The broadband slot array antenna of claim 1, wherein the conductor plate is grounded.

12. The broadband slot array antenna of claim 1, wherein the common slot and the plurality of slot halves exhibit one of a bowtie configuration, a dog-bone configuration, and a paddle-bowtie configuration.

13. The broadband slot array antenna of claim 1, wherein each feed line is one selected from the group consisting of a microstrip, coaxial line, coplanar waveguide, and slot line.

* * * * *